United States Patent [19]

Hatherley

[11] 3,948,191

[45] Apr. 6, 1976

[54] COLLAPSIBLE SHELVING

[75] Inventor: Winnifred Hatherley, Mississauga, Canada

[73] Assignee: The Raymond Lee Organization, Inc., a part interest

[22] Filed: Jan. 14, 1974

[21] Appl. No.: 433,205

[52] U.S. Cl. ..... 108/100; 108/92; 211/90; 211/104; 211/149

[51] Int. Cl.[2] ..... A47B 57/00

[58] Field of Search ..... 108/99, 100, 111, 112, 108/114, 38, 92; 211/149, 104, 87, 90; 297/139, 159; 248/174; 52/183

[56] References Cited

UNITED STATES PATENTS

| | | | |
|---|---|---|---|
| 679,003 | 7/1901 | McRay | 108/92 |
| 821,391 | 5/1906 | Wiltse | 108/100 |
| 1,013,032 | 12/1911 | Lund | 108/92 |
| 1,125,194 | 1/1915 | Sigmund | 108/100 |

*Primary Examiner*—James C. Mitchell

[57] ABSTRACT

Collapsible shelving employs a horizontal rectangular board. A first set of like smaller boards of the same width as the horizontal board but less than half the length are hingedly secured together end to end. A second like set of like smaller boards are also hingedly secured together end to end. The first board in each set is hingedly secured at one end to a corresponding end of the horizontal board. Means secured to aligned edges of all boards enable same to be detachably secured to a wall. In use the first boards in both sets are disposed vertically downward and thereafter the boards in both sets alternate in horizontal and vertical positions.

1 Claim, 3 Drawing Figures

COLLAPSIBLE SHELVING

SUMMARY OF THE INVENTION

This invention is directed to a collapsible shelving structure which can be easily erected and secured to a supporting wall or can be equally easily collapsed and stored.

To this end, a horizontal elongated rectangular board is employed. A first set of like smaller boards having the same width but being less than half as long as the horizontal board and a second like set of like boards are also used. The boards in each set are hingedly secured together end to end. The first board in the first set is hingedly secured at one end to one end of the horizontal board. The first board in the second set is hingedly secured at one end to the other end of the horizontal board.

In use the elongated board is secured at one edge to a supporting wall. The first board in each set is disposed in vertical position below the elongated board and is secured at one edge to this wall. The remaining boards in both sets alternate in horizontal and vertical positions, each horizontal smaller board extending further outward than the previous such board from the elongated board. All the remaining boards are also secured at one edge to the wall.

At least one flat horizontal shelf can be detachably securable to and extends between the bottom edges of aligned vertical corresponding boards of both sets to complete the structure.

The invention can then be used as described below.

DETAILED DESCRIPTION OF PREFERRED EMBODIMENTS

Figure 1:
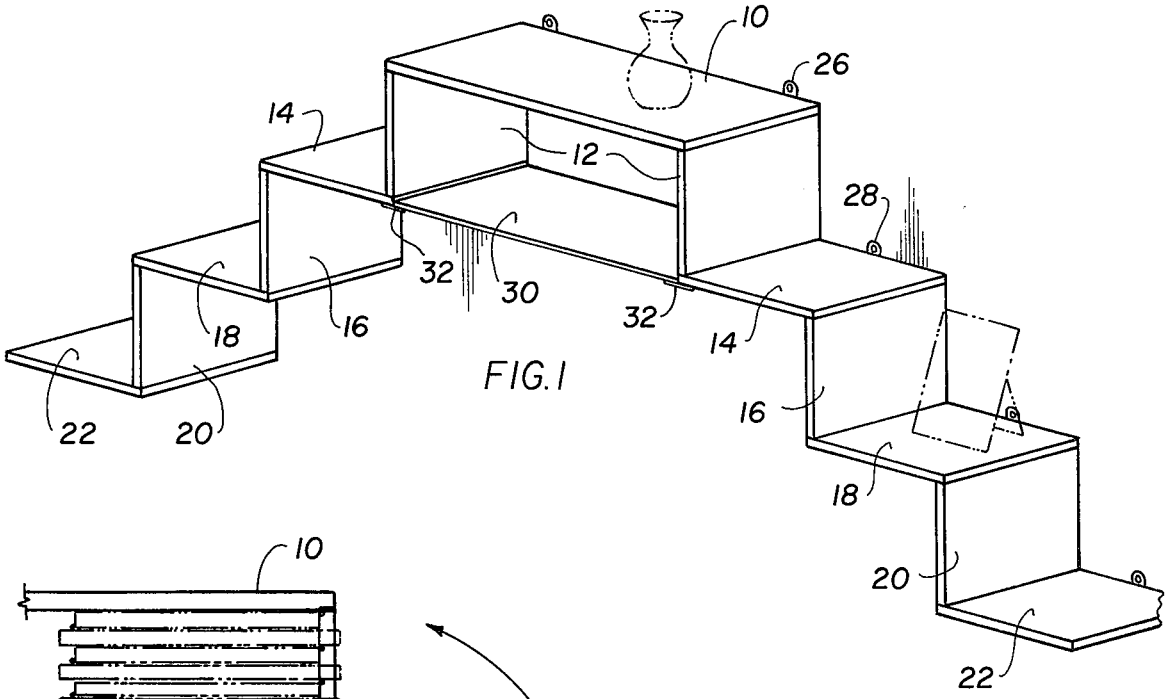
FIG. 1 is a perspective view of the invention in use.
Figure 2:
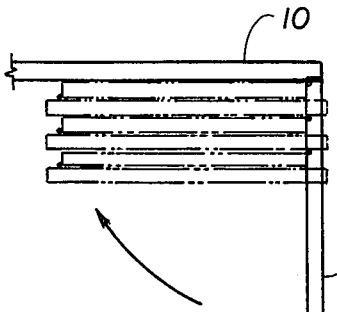
FIG. 2 is an enlarged detail view thereof.
Figure 3:
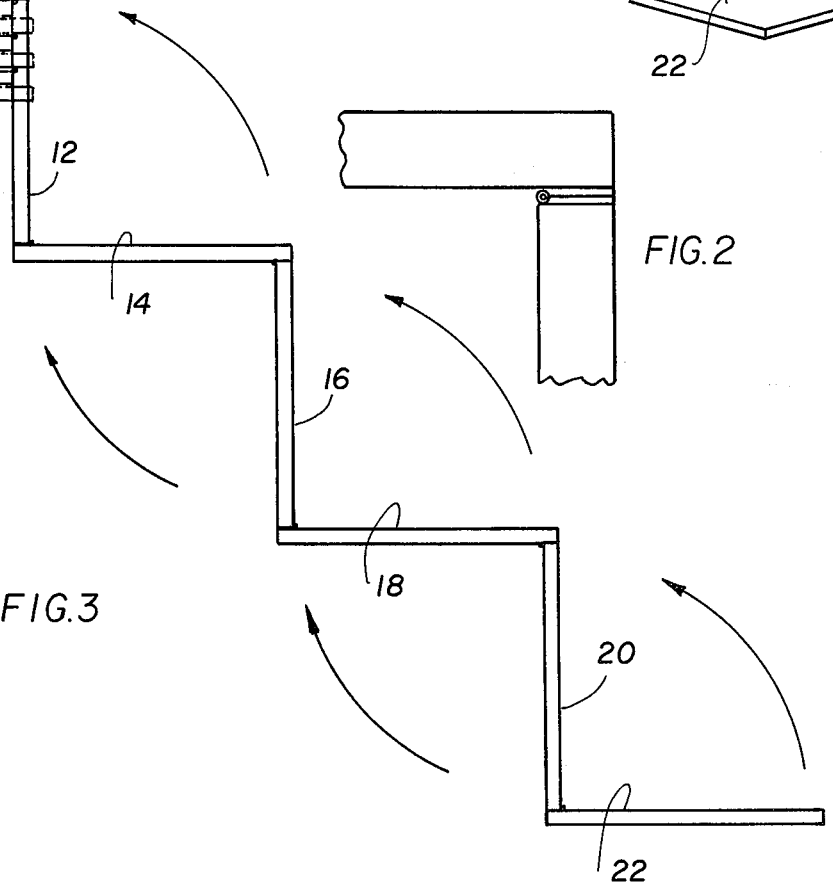
FIG. 3 illustrates the collapsing action of the invention.

Referring now to FIGS. 1–3, an elongated horizontal rectangular board 10 has hingedly secured thereto at each end boards 12 of like width and less than half the length. Additional boards 14, 16, 18, 20 and 22 are hinged to each other at adjacent ends by hinges 24. Each of boards 10, 12, 14, 16, 18, 20 and 22 has secured at one edge a bracket 26 with an opening 28 through which screws can extend into a wall to hold the arrangement in place with boards 12, 16 and 20 disposed vertically and boards 14, 18 and 22 disposed horizontally and extending outwardly from the board 10.

One or more horizontal shelves 30 can have brackets 32 at each end detachably secured by screws or the like to the bottom of adjacent vertical boards to provide an additional support.

While we have described our invention with particular reference to the drawings, such is not to be considered as limiting its actual scope.

Having thus described this invention, what is claimed as new is:

1. Collapsible shelving designed to be attached to a wall and designed to be supported by the walll when in an erected position and further designed to be collapsible and non-free-standing when detached from the wall, comprising:

a horizontal elongated rectangular board;

a plurality of non-elongated smaller boards that are equal in width to the width of the elongated rectangular board and that are less than half the length of the elongated rectangular board, the smaller boards being arranged into two like sets of boards, with each set of boards being connected together end to end to form a series and with each set connected at one end to a corresponding tip of the elongated rectangular board to form two like opposed sets of boards attached to and depending from opposed tips of the elongated rectangular board;

a like plurality of like hinges connecting the smaller boards in each set together and connecting each set to the elongated rectangular board;

means secured to aligned edges of all the boards to detachably secure them to a wall, with the elongated rectangular board being in a horizontal plane and being perpendicular to the smaller boards attached to it at each tip, and the boards in each of the sets of smaller boards being alternately vertical and horizontal to form two non-elongated stairway-like structures extending upwardly towards the elongated rectangular board when the boards are attached to the wall; and a flat horizontal shelf detachably securable to and extending between the bottom edges of corresponding vertically aligned boards in each set, when the boards are secured to a wall.

* * * * *